United States Patent [19]

Piegay

[11] 4,405,149

[45] Sep. 20, 1983

[54] SKI WITH VIBRATION-DAMPING MEANS

[75] Inventor: Yves Piegay, Voiron, France

[73] Assignee: Skis Rossignol S.A., Voiron, France

[21] Appl. No.: 257,114

[22] Filed: Apr. 24, 1981

[30] Foreign Application Priority Data

| | | | |
|---|---|---|---|
| Feb. 21, 1980 | [FR] | France | 80 04128 |
| Apr. 9, 1981 | [FR] | France | 81 07520 |
| Apr. 13, 1981 | [EP] | European Pat. Off. | 81420053.1 |
| Apr. 23, 1981 | [CA] | Canada | 376036 |
| Apr. 23, 1981 | [JP] | Japan | 56-60720 |

[51] Int. Cl.[3] ..... A63C 5/04

[52] U.S. Cl. ..... 280/602; 280/610

[58] Field of Search ..... 280/601, 602, 610

[56] References Cited

U.S. PATENT DOCUMENTS

| | | | |
|---|---|---|---|
| 4,071,264 | 1/1978 | Legrand et al. | 280/602 |
| 4,094,528 | 6/1978 | Cluzel | 280/610 |
| 4,233,098 | 11/1980 | Urbain | 280/610 |

*Primary Examiner*—Joseph F. Peters, Jr.
*Assistant Examiner*—Kenneth R. Rice
*Attorney, Agent, or Firm*—Karl F. Ross; Herbert Dubno

[57] ABSTRACT

A ski which is provided internally with vibration-damping elements. According to the invention, at least two vibration-damping elements in the form of bands or strips of constrained visco-elastic material extend longitudinally within the ski and are spaced apart therein. The bands have lengths of 10 to 20% of the total length of the ski and a spacing which can also be equal to 10 to 20% of the total length of the ski. When the ski is a tour ski, e.g. for alpine touring or cross-country, three such bands may be provided, one at the spoon or point of the ski, one in the region of the binding and one at the heel of the ski. When the ski is for downhill or slalom skiing, two such bands are provided, one at the spoon or point and the other at the binding region.

8 Claims, 4 Drawing Figures

SKI WITH VIBRATION-DAMPING MEANS

FIELD OF THE INVENTION

My present invention relates to skis, and more particularly, to skis provided with vibration-damping means.

BACKGROUND OF THE INVENTION

Conventional skis, whether because of the ski structure or because of the nature of the snow upon which the ski is to slide, are frequently induced to vibrate and thereby create problems. These problems include the generation of noise which is an inconvenience to the skier, the transmission of vibrations to the legs of the skier thereby leading to discomfort of the skier, and the creation of drawbacks in skiing performance. These drawbacks include the grip of the ski on ice or frozen snow, the stability of the ski as it passes over humps and rises, and the stability of the ski during turns. Furthermore, the vibration severely limits the free-sliding characteristics of the ski on the snow.

To avoid these drawbacks it has already been proposed to include within the body of the ski a damping element capable of absorbing or reducing the vibration thereof.

The original efforts provided this damping element over the entire length of the ski. This has been shown to increase the comfort of the skier. However, the grip of the ski on ice or frozen snow is not improved nor does the ski appear to provide greater stability over short rises and during turns.

When efforts were made to reduce the length of the vibration-damping element to the front half of the length of the ski, i.e., the zone between the spoonal point and the binding, little advantage was found over the use of the vibration-damping element over the entire length of the ski.

Thus while the earlier efforts have appeared to solve the problem of skiing comfort by reducing vibrations which are transmitted to the legs of the skier, they have not proved successful with respect to the quality of skiing and the skiing performance.

OBJECTS OF THE INVENTION

It is the principal object of the present invention to provide a ski which obviates the drawbacks of earlier skis as discussed above.

Another object of the invention is to provide a ski with vibration-damping means such that the skiing comfort is improved and at the same time there is an improvement in the performance of the ski, especially with respect to its ability to grip on ice and frozen snow, its stability on rises or humps, and its stability during turns.

SUMMARY OF THE INVENTION

These objects and others which will become apparent hereinafter are attained, in accordance with the invention which is based upon my surprising discovery that significantly improved results can be obtained by substituting for the shock-damping member heretofore incorporated in the ski, a plurality of such members of sharply reduced length and in longitudinally spaced relationship.

According to the invention, therefore, a ski comprises at least two bands or strips of a constrained viscoelastic (prestressed or confined elastomeric) material extending longitudinally within the ski and longitudinally spaced from one another within the ski structure. The length of each band should be between 10 and 20% of the total length of the ski and the spacing between the elements can also correspond to 10 to 20% of the length of the ski but may be as great as 30% of the total length thereof.

The number and relative position of these band serving as damping elements is a function of the use of the ski and the qualities designed for this use.

For example, I have found it to be advantageous for tour skis, i.e. skis used for alpine touring, cross-country purposes and the like, to provide three damping bands disposed respectively in the region of the spoon or point of the ski, the region of the binding of the ski and in the region of the heel or rear of the ski.

With three bands of this type, the skiing comfort is sharply improved and one also obtains a significant improvement in the ability of the ski to grip on frozen snow or ice, in the stability of the ski as it passes over rises or humps, and in the stability of the ski during turns.

The vibration is damped or eliminated and the lack of vibration is noticeable even when the ski is traveling over hard and irregular surfaces.

For specialty skis, e.g. skis designed primarily for downhill skiing and for the giant slalom, it has been found to be advantageous to provide only two damping bands. One of these bands of constrained viscoelastic material is located in the region of the spoon or point of the ski while the other band is located in the region of the binding.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 4:
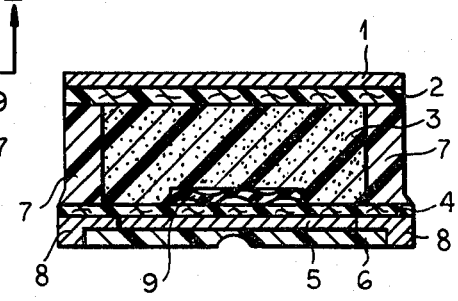
FIG. 4 is a section similar to FIG. 2 illustrating yet another embodiment of the invention.
Figure 2:
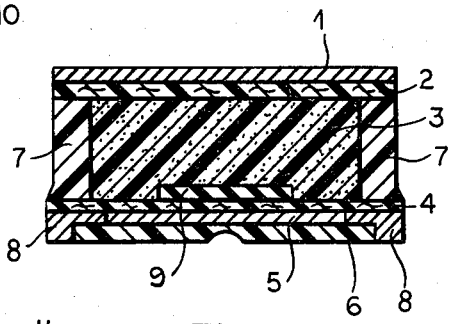
FIG. 2 is a section drawn to a larger scale and taken along the line II—II of FIG. 1.

The internal structure of a ski according to the invention can be seen readily from FIGS. 2 and 4. The ski comprises at its upper surface, a metal sheet 1 which is bonded to a hardened layer 2 of glass fiber or fabric embedded in an epoxy resin.

The bottom surface of the ski is formed by a polyethylene strip 6 bonded to a metal layer 5 between a pair of metal edge strips 8. Another flexible glass-fiber or fabric layer impregnated with epoxy resin and appropriately hardened is provided at 4 and the layers 2 and 4 together with lateral cheeks 7 of phenolic resin or an acrylonitrile-butadiene-styrene (ABS) resin defines a space which is filled with a foam-synthetic resin, e.g. a polyurethane 3.

The damping element, in the form of a band 9, is provided within this space as well and consists of a constrained viscoelastic (prestressed or confined elastomeric) band. This band may be stressed in tension or in compression and advantageously is stressed both longitudinally and transversely before being bonded to the layer 4 in the stretched state with, for example, an alpha-cyanoacrylate adhesive. It may consist of a soft rubber. In the embodiment of FIG. 4, however, the band 9', although stretched longitudinally before being bonded to the layer 4, is compressed laterally so as to have a slightly corrugated appearance.

Figure 1:
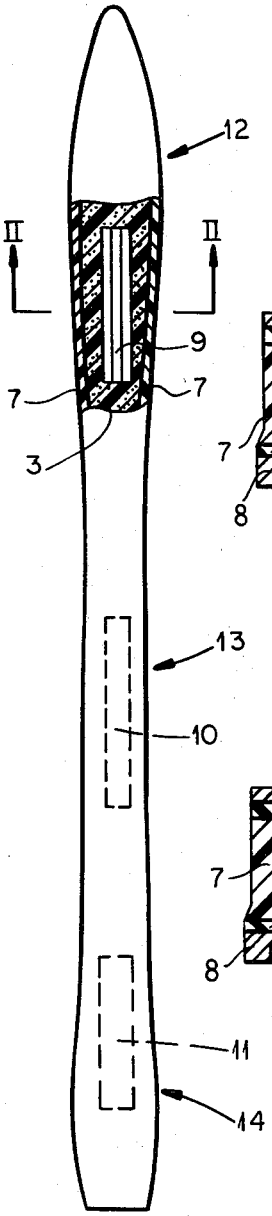
FIG. 1 is a diagrammatic top-plan view of a ski embodying the invention, partly broken away.

According to the invention, the ski shown in FIG. 1, i.e. a tour ski, comprises three such damping elements, 9, 10 and 11 which are disposed as shown in FIGS. 2 and 4 at the lower part of the core 3 in contact with the layer 4 and preferably bonded thereto. Naturally, the damping elements 9, 10 and 11 (or 15 and 16) can be constrained merely by the core material 3 if desired.

Each of the bands 9, 10 and 11 has a length which is significantly less than the total length of the ski.

Thus, the damping band 9 is disposed at a forward portion in the region of the spoon 12, and has a length between 10 and 20%, preferably about 15% of the total length of the ski, i.e. the length of the ski pressed flat.

The damping element 10 is disposed at a central push of the ski in the region of the binding and can have a length between 15 and 25% of the total length of the ski, preferably about 20% thereof.

The rear-damping element 11 can be disposed in the region of the heel of the ski 14 and has a length which is 10 to 20% of the total length of the ski, preferably about 15% of the total length thereof. The spoon region is represented at 12 and the binding region at 13 in FIG. 1.

Figure 3:
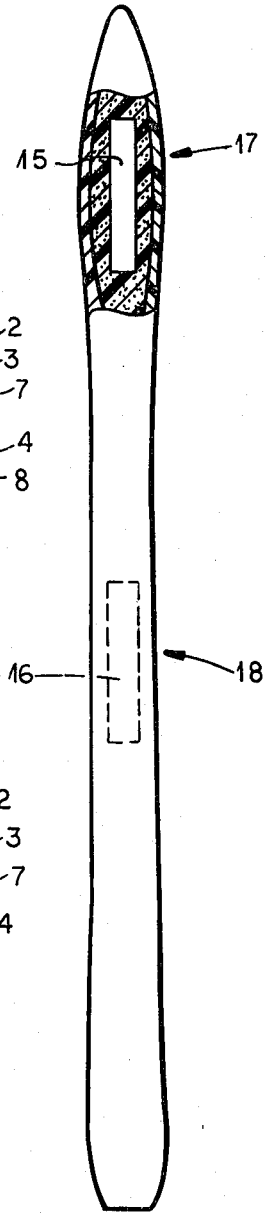
FIG. 3 is a view similar to FIG. 1 of a slalom ski representing a second embodiment of the invention.

The ski shown in FIG. 3, intended especially for the giant slalom, utilizes only two damping elements 15 and 16.

The damping band 15 is disposed in the region 17 of the spoon while the damping band 16 is disposed in the region 18 of the binding, each of the bands having a length of about 25 cm when the ski has a length between 2 m and 2.05 m.

When the ski is used in the giant slalom, it is found to have perfect stability in travel through curves and over humpy and irregular terrain to provide excellent grip in the lateral sense and to have excellent dimensional stability even at elevated speeds.

In all cases, the viscoelastic bands 9, 10, 11, 15 and 16, are constrained, i.e. confined in all directions by the core material 3 and thus any force applied to the bands results in a stress thereto yieldably resisted by a restoring force.

In the configurations shown, the bands have been found to provide marked freedom from vibration transmission to the legs of the skier.

I claim:

1. A ski comprising an elongated ski body having a spoon at the forward end thereof, a binding region centrally thereof and a heel at the rear end of the body, said body being formed with a core, and at least two generally flat bands of visco-elastic material constrained within said core and spaced apart longitudinally along said body, said bands extending longitudinally within said body and each having a length between 10 and 20% of the total length of the ski.

2. The ski defined in claim 1, wherein said body comprises an upper metal plate, a glass-reinforced epoxy resin layer below said metal plate, said core below said layer, a pair of synthetic resin cheeks flanking said core, another glass-reinforced epoxy layer below said core, said core being a foamed polyurethane, a further metal sheet below said other glass-reinforced epoxy layer, and a polyethylene strip below the latter metal sheet, a pair of metal edges flanking said polyethylene strip.

3. The ski defined in claim 2 wherein said bands rest against said other glass-reinforced layer.

4. A ski comprising an elongated ski body having a spoon at the forward end thereof, a binding region centrally thereof and a heel at the rear end of the body, said body being formed with a core, and at least two generally flat bands of visco-elastic material constrained within said core and spaced apart longitudinally along said body, said bands extending longitudinally within said body and each having a length between 10 and 20% of the total length of the ski, said body including three longitudinally spaced bands of visco-elastic material constrained in said core, one of said bands being disposed in the region of said spoon, a second of said bands being disposed in said binding region and a third of said bands being disposed in the region of said heel.

5. The ski defined in claim 4 wherein the bands disposed in the region of said spoon and in the region of said heel have lengths of 10 to 20% of the total length of the ski, the band disposed in said binding region having a length between 15 and 20% of the total length of the ski.

6. A ski comprising an elongated ski body having a spoon at the forward end thereof, a binding region centrally thereof and a heel at the rear end of the body, said body being formed with a core, and at least two generally flat bands of visco-elastic material constrained within said core and spaced apart longitudinally along said body, said bands extending longitudinally within said body and each having a length between 10 and 20% of the total length of the ski, only two such bands being provided, one of said bands being disposed in the region of said spoon, in the other of said bands being disposed in the region of said binding.

7. The ski defined in claim 4, claim 5 or claim 6 wherein said body comprises an upper metal plate, a glass-reinforced epoxy resin layer below said metal plate, said core below said layer, a pair of synthetic resin cheeks flanking said core, another glass-reinforced epoxy layer below said core, said core being a foamed polyurethane, a further metal sheet below said other glass-reinforced epoxy layer, and a polyethylene strip below the latter metal sheet, a pair of metal edges flanking said polyethylene strip.

8. The ski defined in claim 7 wherein said bands rest against said other glass-reinforced layer.

* * * * *